US011859450B2

(12) United States Patent
Gao et al.

(10) Patent No.: US 11,859,450 B2
(45) Date of Patent: Jan. 2, 2024

(54) DRILLING FLUID CHANNEL STRUCTURE OF CORE DRILLING RIG

(71) Applicants: SHENZHEN UNIVERSITY, Guangdong (CN); SICHUAN UNIVERSITY, Sichuan (CN)

(72) Inventors: Mingzhong Gao, Sichuan (CN); Heping Xie, Sichuan (CN); Ling Chen, Sichuan (CN); Jun Guo, Sichuan (CN); Zhilong Zhang, Sichuan (CN); Zetian Zhang, Sichuan (CN); Ru Zhang, Sichuan (CN); Yiqiang Lu, Sichuan (CN); Cong Li, Sichuan (CN); Zhiqiang He, Sichuan (CN)

(73) Assignees: SHENZHEN UNIVERSITY, Guangdong (CN); SICHUAN UNIVERSITY, Sichuan (CN)

( * ) Notice: Subject to any disclaimer, the term of this patent is extended or adjusted under 35 U.S.C. 154(b) by 322 days.

(21) Appl. No.: 17/309,235

(22) PCT Filed: Nov. 12, 2018

(86) PCT No.: PCT/CN2018/114963
§ 371 (c)(1),
(2) Date: Mar. 11, 2022

(87) PCT Pub. No.: WO2020/093411
PCT Pub. Date: May 14, 2020

(65) Prior Publication Data

US 2022/0213736 A1 Jul. 7, 2022

(30) Foreign Application Priority Data

Nov. 8, 2018 (CN) ..... 201811327013.4

(51) Int. Cl.
*E21B 10/60* (2006.01)
*E21B 25/08* (2006.01)
*E21B 25/10* (2006.01)

(52) U.S. Cl.
CPC ..... *E21B 10/605* (2013.01); *E21B 25/08* (2013.01); *E21B 25/10* (2013.01)

(58) Field of Classification Search
CPC ..... E21B 10/61; E21B 10/605; E21B 25/08; E21B 25/10
See application file for complete search history.

(56) References Cited

U.S. PATENT DOCUMENTS 4,773,489 A * 9/1988 Makohl ..... E21B 4/02 175/246
6,644,424 B1 * 11/2003 Fanuel ..... E21B 25/02 175/252
2017/0306713 A1 * 10/2017 Connell ..... E21B 25/10

FOREIGN PATENT DOCUMENTS

CN 203066857 U 7/2013
CN 105003219 A 10/2015
(Continued)

*Primary Examiner* — Christopher J Sebesta
(74) *Attorney, Agent, or Firm* — NKL Law; Allen Xue

(57) ABSTRACT

A drilling fluid channel structure of a core drilling rig includes a fluid channel activation module, a pressure relief module, a flow diverging and blocking module, a driving fluid channel and a cooling fluid channel. The fluid channel activation module, the pressure relief module and the flow diverging and blocking module are connected sequentially from the rear to the front. The driving fluid channel and the cooling fluid channel are connected at the rear side thereof to the flow diverging and blocking module. The driving fluid channel includes a driving section located between a stator and a rotor of a driving motor. The driving fluid channel is provided with a driving fluid outlet at the front side of the driving section. The cooling fluid channel passes through a
(Continued)

layer disposed between an integrity-preserving compartment and an outer barrel.

9 Claims, 9 Drawing Sheets

(56) References Cited

FOREIGN PATENT DOCUMENTS

| | | | |
|---|---|---|---|
| CN | 105735928 | A | 7/2016 |
| WO | 9920870 | A1 | 4/1999 |
| WO | 2004029401 | A1 | 4/2004 |

* cited by examiner

DRILLING FLUID CHANNEL STRUCTURE OF CORE DRILLING RIG

TECHNICAL FIELD

The present invention relates to a core drilling system, and especially to a drilling fluid channel structure of core drilling rig.

BACKGROUND ART

In the process of oilfield exploration, rock core is the key material for discovering oil and gas reservoir, as well as studying stratum, source rock, reservoir rock, cap rock, structure, and so on. Through the observation and study of the core, the lithology, physical properties, as well as the occurrence and characteristics of oil, gas, and water can be directly understood. After the oilfield is put into development, it is necessary to further study and understand the reservoir sedimentary characteristics, reservoir physical properties, pore structure, wettability, relative permeability, lithofacies characteristics, reservoir physical simulation, and reservoir water flooding law through core. Understanding and mastering the water flooded characteristics of reservoirs in different development stages and water cut stages, and finding out the distribution of remaining oil can provide scientific basis for the design of oilfield development plan, formation system, well pattern adjustment, and infill well.

Coring is to use special coring tools to take underground rocks to the ground in the process of drilling, and this kind of rock is called core. Through it, various properties of rocks can be determined, underground structure and sedimentary environment can be studied intuitively, and fluid properties can be understood, etc. In the process of mineral exploration and development, the drilling work can be carried out according to the geological design of strata and depth, and coring tools were put into the well, to drill out rock samples.

The downhole temperature is high, and electrical equipment cannot be used, thus hydraulic equipment is often used. Before starting the hydraulic equipment, the fluid channel should be blocked. After starting, the fluid channel should be unblocked to provide hydraulic pressure for the working parts, drive the hydraulic motor and cool the drill bit.

Content of the Invention

The present invention is intended to provide a drilling fluid channel structure of core drilling rig, which can drive the motor, make the drill bit rotate, cool the rotating bit, control the start and stop of the motor, and automatically relieve the pressure after the motor stops.

In order to realize the above objectives, the technical solutions adopted by the present invention are as follows:

The drilling fluid channel structure of a core drilling rig, disclosed in the present invention, comprises a fluid channel activation module, a pressure relief module, a flow diverging and blocking module, a driving fluid channel, and a cooling fluid channel. The fluid channel activation module, the pressure relief module and the flow diverging and blocking module are connected sequentially from the rear to the front. The driving fluid channel and the cooling fluid channel are connected at the rear side thereof to the flow diverging and blocking module. The driving fluid channel comprises a driving section, which is located between a stator and a rotor of a driving motor. The driving fluid channel is provided with a driving fluid outlet, which is in front of the driving section. The cooling fluid channel passes through a layer disposed between an integrity-preserving compartment and an outer barrel. The front end of the outer barrel is connected to a drill bit, and a front opening of the cooling fluid channel is located at the drill bit.

Further, the rear section of the central rod is also included, which passes through the fluid channel activation module, the pressure relief module, and the flow diverging and blocking module. Said fluid channel activation module comprises a lock body, a locking rod, and a start shear pin. The locking rod is in the lock body, and the locking rod and the lock body are connected by the start shear pin (53). The rear section of the central rod is in the locking rod. The lock body comprises a sealing section A, while the locking rod comprises a sealing section B. The sealing section A and the sealing section B are in a sealing fit. Said sealing section B is in a sealing fit with the rear section of the central rod. There is a fluid channel A between the rear section of the central rod and the locking rod, and the back opening of the fluid channel A is at the rear end of the locking rod. The locking rod is provided with an outflow hole A, that is connected to the fluid channel A. The outflow hole A is behind the sealing section B. There is a fluid channel B between the lock body and the locking rod, and the fluid channel B is in front of the sealing section A. Before the start shear pin is cut, the outlet of the outflow hole A is at the sealing section A, and the front end of the fluid channel A is sealed. After the start shear pin is cut, the locking rod moves forward, and the outlet of the outflow hole A is located in front of the sealing section A. The fluid channel A and the fluid channel B are connected through the outflow hole A.

Further, said flow diverging and blocking module comprises a valve housing, a lock housing and a trigger mechanism. The rear section of central rod passes through the inner cavity of the valve housing. The valve housing is inside the lock housing. From back to front, the valve housing comprises a sealing section C and a diversion section. The lock housing includes an inflow section B and an outflow section B from back to front. There is a fluid channel D between the rear end of the central rod and the inflow section B, while there is a fluid channel E between the outer wall of the rear section of the central rod and the inner wall of the valve housing. The back end of fluid channel D communicates with fluid channel B, and fluid channel E communicates with fluid channel D, and fluid channel E communicates with the cooling fluid channel. The inner diameter of the inflow section B is greater than the outer diameter of the sealing section C, while the outer diameter of the sealing section C is longer than the outer diameter of the diversion section, and the inner diameter of the outflow section B is equal to the outer diameter of the sealing section C. The outflow section B is provided with an outflow hole B, which is connected to the driving fluid channel. Before stopping the drilling, the front end of sealing section C is in the inflow section B, and the fluid channel D and the outflow hole B are connected. After stopping the drilling, the sealing section C and the outflow section B are in a sealing fit, and the fluid channel D is separated from the outflow hole B.

Further, said valve housing further includes a locking section A, which is connected to the front end of the diversion section. The lock housing also includes a locking section B, that is connected to the front end of the outflow section B. The trigger mechanism includes a locking sleeve, a fixing ring, and a safety gear. The locking sleeve is inside the outer barrel. The lock housing passes through the inner cavity of the locking sleeve, and a safety gear is connected to the inner wall of the outer barrel. The outer wall of the locking section A is provided with a locking groove A. The locking section B has a locking hole A, which is a through hole. There is a locking ball in the locking hole A. The diameter of the locking ball is greater than the depth of the locking hole A. The locking sleeve includes an impact section and the locking section C from back to front. The inner wall of the locking section C has a locking groove B, and the fixing ring is fixed on the outer wall of the locking section B. The fixing ring is behind the locking hole A. The inner diameter of the impact section is longer than the outer diameter of the fixing ring. The locking section C is in front of the fixing ring. The safety gear includes the clamping part and the pressing part from back to front. The inner diameter of the front end of the pressing part is shorter than the outer diameter of the impact section, while the inner diameter of the pressing part is not less than the outer diameter of the fixing ring. The inner diameter of the front end of the clamping part is shorter than the outer diameter of the rear end of the fixing ring. There is a limit end at the front end of the rear section of the central rod, and the limit end is in the locking section B and in front of the locking section A. The axial distance from the front end of the clamping part to the front end of the pressing part is equal to the axial distance from the hole center of the locking hole A to the center of the locking groove B before stopping the drilling. Before stopping the drilling, the distance from the rear end of the sealing section C to the rear end of the outflow hole B is greater than the axial distance from the hole center of the locking hole A to the center of the locking groove A. The axial distance from the hole center of the locking hole A to the center of the locking groove A after stopping the drilling is greater than the distance from the front end of the sealing section C to the front end of the outflow hole B before stopping the drilling.

Further, the front end of the limit end is connected to the front section of the central rod. There is a fluid channel F in the axial direction inside the front section of the central rod, and the limit end is provided with a cooling fluid inlet. The fluid channel E is connected to the fluid channel F through the cooling fluid inlet. The front end of the central rod front section is sealed, which is connected to the integrity-preserving compartment (3). The front section of the central rod and the integrity-preserving compartment are both in the outer barrel. The front side wall of the front section of the central rod is provided with a cooling fluid outlet, and there is a fluid channel G in the layer disposed between an integrity-preserving compartment and an outer barrel, which is connected to the fluid channel F through the cooling fluid outlet. The cooling fluid channel comprises the fluid channel F, the fluid channel G, the cooling fluid inlet and the cooling fluid outlet, and the front end of the fluid channel G is opened at the drill bit. Further, the pressure relief module comprises a connecting pipe and a lock pin. The front end of the connecting pipe is connected to the lock housing, while the rear end of the connecting pipe is connected to the lock body. The rear end of the lock pin is connected to the locking rod. The rear section of the central rod passes through the inner cavity of the lock pin, which is in the connecting pipe. A fluid channel C is arranged between the rear section of the central rod, the lock pin and the locking rod. The side wall of the locking rod is provided with an inflow hole, and the fluid channel B and the fluid channel C are communicated through the inflow hole. The fluid channel C is communicated with the fluid channel D. The connecting pipe comprises a pressure relief section and a flow blocking section from back to front, and the lock pin is in a sealing fit with the flow blocking section. The inner diameter of the flow blocking section is shorter than that of the pressure relief section. The pressure relief section is provided with a pressure relief hole, which is a through hole. There is a shearing plunger in the fluid channel B, and the inner diameter of the shearing plunger is greater than the outer diameter of the lock pin and the locking rod. The shearing plunger is connected to the lock body through the end shear pin. The shearing plunger includes a shearing section and a recoil section from back to front. The outer wall of the shearing section is in a sealing fit with the inner wall of the lock body, and the outer diameter of the recoil section is equal to the inner diameter for the front part of the pressure-relief hole in the pressure-relief section. Before stopping the drilling, the front end of the recoil section is in front of the front end of the pressure-relief hole, and the recoil section is in a sealing fit with the front part of the pressure-relief hole in the pressure-relief section. After stopping the drilling, front liquid backflow impacts the front end of the shearing plunger, and the shearing plunger moves backward. The front end of the recoil section is behind the front end of the pressure-relief hole, and the fluid channel B communicates with the pressure-relief hole.

Further, the outflow hole A is inclined forward from the inside to the outside, there are a plurality of outflow holes A, and outflow holes A are evenly distributed in radial direction along the circumference.

Further, there are a plurality of inflow holes, which are distributed forward and backward on different sides.

Further, the width of the fluid channel E is shorter than that of the outflow hole B, and the width of the fluid channel E is shorter than that of the driving fluid channel.

Further, the driving fluid channel narrows at the driving fluid outlet, which is in a radial direction and behind the integrity-preserving compartment.

The present invention has the following beneficial effects:

1. Before starting, the shear pin fixes the connecting rod, and the outflow hole is in the sealing section A. The outer wall opening of the outflow hole is sealed, and the fluid cannot flow out. When the hydraulic pressure provided by the rear mud pump reaches the starting value, the shear pin is broken, and the locking rod moves forward. The fluid flows through the fluid channel formed by the outer wall of the rear section of the central rod and the inner wall of the connecting section and the inner wall of the outflow section, enters the fluid channel formed by the inner wall of the fluid channel section and the outer wall of the inflow section through the outflow hole, and moves into the fluid channel formed by the outer wall of the rear section of the central rod and the inner wall of the inflow section through the inflow hole, which is connected to the hydraulic motor and the drill bit ahead, so that the hydraulic motor is started, and the drill bit is cooled;
2. Before stopping the drilling, the locking ball is in the locking hole A and the locking groove A, to lock the valve housing and keep the fluid channel D in communication with the front hydraulic motor through the outflow hole B. When the outer barrel moves forward to the stop position, the outer barrel drives the safety gear to hit the locking sleeve, to move the locking sleeve forward. The locking groove B is directly opposite to the locking hole A, and the radial restraint of the locking ball is released. The fluid impacts the rear end of the valve housing, the locking ball is squeezed into the locking groove B, and the valve housing moves forward. The sealing section C separates the fluid channel D from the outflow hole B, that stops supplying energy to the front motor, and the motor is off. Because the fluid channel D is blocked, the liquid flows backwards and runs back to the fluid channel B. The recoil shears the front end of the plunger, the shearing plunger receives the backward force, and thus the shearing plunger moves backward. The front end of the recoil section moves to behind the pressure-relief hole, the fluid channel B communicates with the outside through the pressure-relief hole, and the liquid is discharged from the pressure-relief hole;

3. The width of the fluid channel E is less than the width of the outflow hole B, and the width of the fluid channel E is less than the width of the driving fluid channel. After diverging the flow, the hydraulic pressure of the driving fluid channel is high, which is good for driving the motor. However, the hydraulic pressure of the cooling fluid channel is low, only a small amount of drilling fluid reaches the drill bit, which is conducive to underbalanced reflow of the surface water at the drill bit. The surface water cleans the core and prevents the core from being contaminated by the drilling fluid, so that the integrity of the core is preserved;
4. The driving fluid channel narrows at the driving fluid outlet, which facilitates the converging of driving fluid at the outlet. The driving fluid outlet faces the radial direction, to prevent the driving fluid from spraying forward. The driving fluid outlet is behind the integrity-preserving compartment, and after the driving fluid is sprayed from the driving fluid outlet, the driving fluid flows backwards to prevent a large amount of driving fluid from polluting the core collected.

In Figure: 1-central rod, 11-rear section of central rod, 12-front section of central rod, 121-cooling fluid outlet, 2-outer barrel, 21-safety gear, 211-clamping part, 212-pressing part, 22-drill bit, 221-blade, 3-integrity-preserving compartment, 41-driving fluid channel, 411-driving section, 412-driving fluid outlet, 42-cooling fluid channel, 421-front opening of cooling fluid channel, 431-fluid channel A, 432-fluid channel B, 433-fluid channel C, 434-fluid channel D, 435-fluid channel E, 436-fluid channel F, 437-fluid channel G, 51-locking rod, 511-connecting section, 5111-start shear pin groove, 512-outflow section A, 5121-outflow hole A, 513-sealing section B, 514-inflow section A, 5141-inflow hole, 52-lock body, 521-locking section, 5211-start shear pin hole, 522-sealing section A, 523-fluid channel section, 53-start shear pin, 54-lock nut, 541-fixing section, 542-threaded section, 55-sealing steel ring, 56-fixing screw, 61-valve housing, 611-sealing section C, 612-diversion section, 613-locking section A, 6131-locking groove A, 62-lock housing, 621-inflow section B, 622-outflow section B, 6221-outflow hole B, 623-locking section B, 6231-locking hole A, 6232-locking hole B, 63-locking sleeve, 631-impacting section, 632-locking section C, 6321-locking groove B, 6322-locking groove C, 64-locking Ball, 65-fixing ring, 66-limit end, 661-locking groove D, 662-cooling fluid inlet, 67-clamping ring, 71-lock pin, 72-connecting pipe, 721-pressure relief section, 7211-pressure relief hole, 722-blocking section, 73-shearing plunger, 731-shearing section, 732-recoil section, 74-end shear pin.

Examples

In order to make the objectives, technical solutions, and advantages of the present invention clearer, the present invention will be further illustrated hereinafter by combing with the attached Figures.

Figure 1:
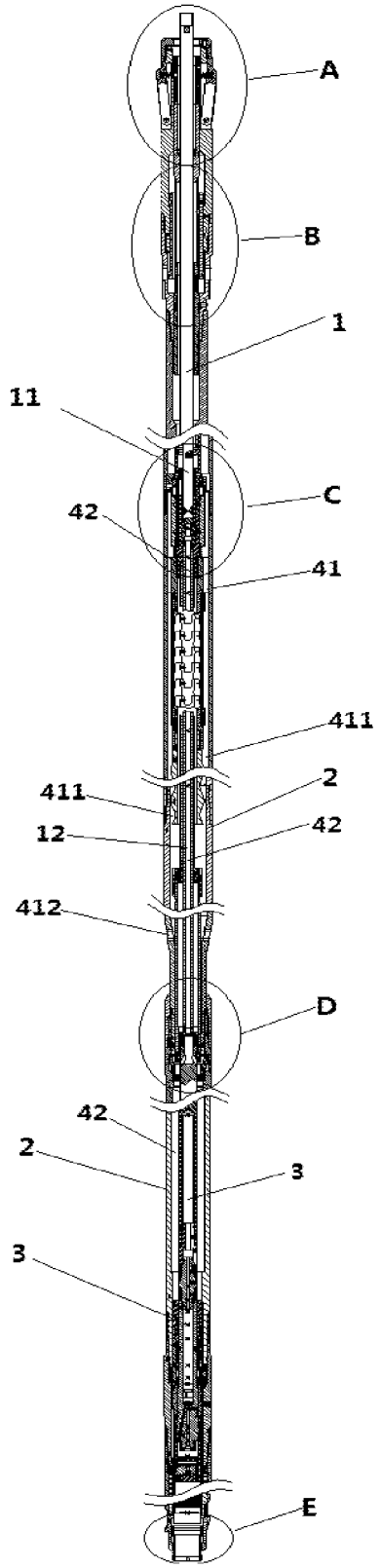
FIG. 1. Schematic diagram of the present invention.

As shown in FIG. 1, the drilling fluid channel structure of a core drilling rig, disclosed in the present invention, comprises a fluid channel activation module, a pressure relief module, a flow diverging and blocking module, a driving fluid channel 41, a cooling fluid channel 42, and a central rod 1. The fluid channel activation module, the pressure relief module, and the flow diverging and blocking module are connected sequentially from the rear to the front. The central rod 1 passes through the fluid channel activation module, the pressure relief module, and the flow diverging and blocking module. The central rod 1 comprises the front section 12 and the rear section 11. The driving fluid channel 41 and the cooling fluid channel 42 are connected at the rear side thereof to the flow diverging and blocking module. The driving fluid channel 41 comprises a driving section 411, which is located between a stator and a rotor of a driving motor. The driving fluid channel 41 is provided with a driving fluid outlet 412, which is in front of the driving section 411. The driving fluid channel 41 is narrowed at the driving fluid outlet 412, which faces the radial direction and is behind the integrity-preserving compartment 3. The cooling fluid channel 42 passes through a layer disposed between an integrity-preserving compartment 3 and an outer barrel 2. The front end of the outer barrel 2 is connected to a drill bit 22, and a front end opening 421 of the cooling fluid channel is located at the side wall blade of the drill bit 22.

Figure 2:
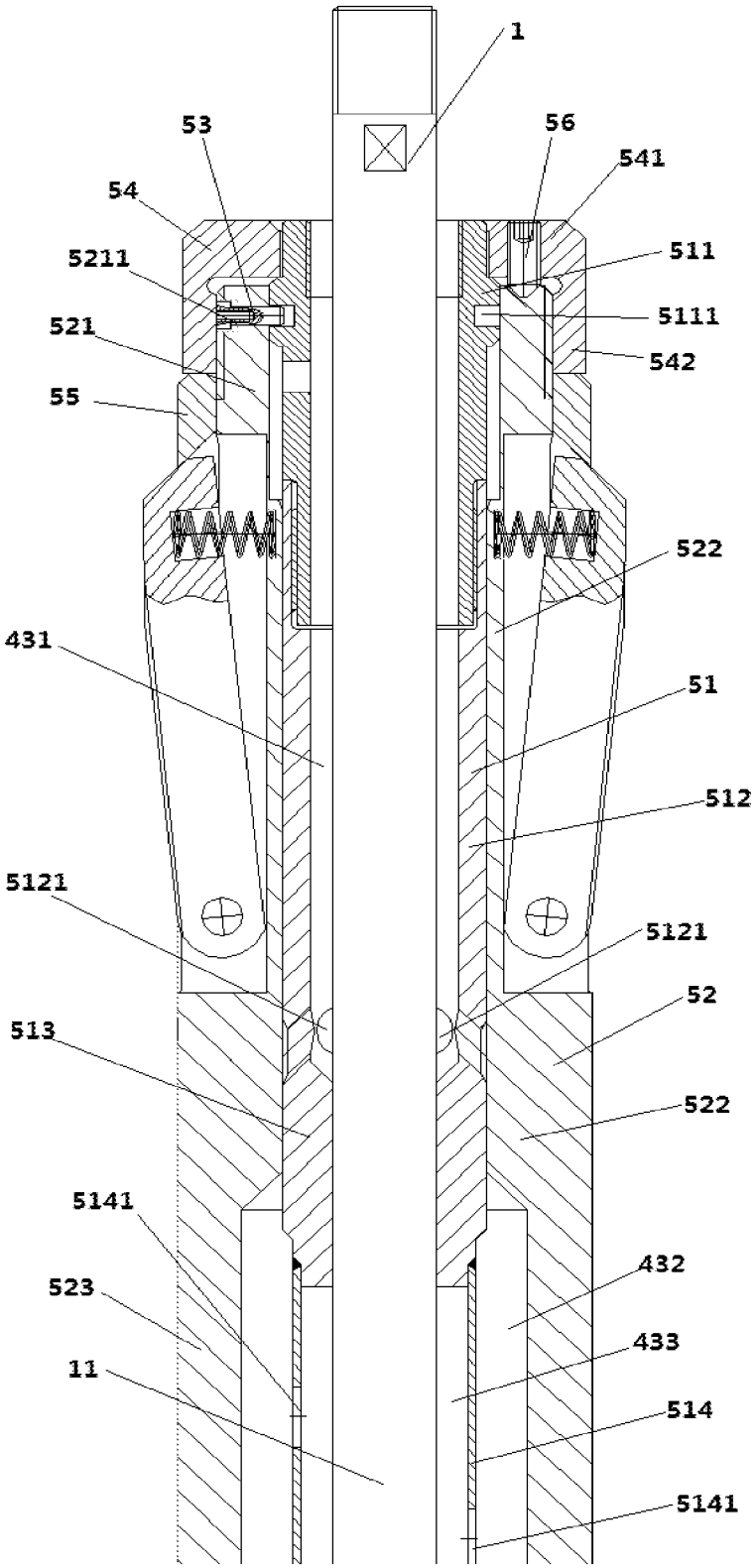
FIG. 2. An enlarged view of part A before the start shear pin is cut.
Figure 3:
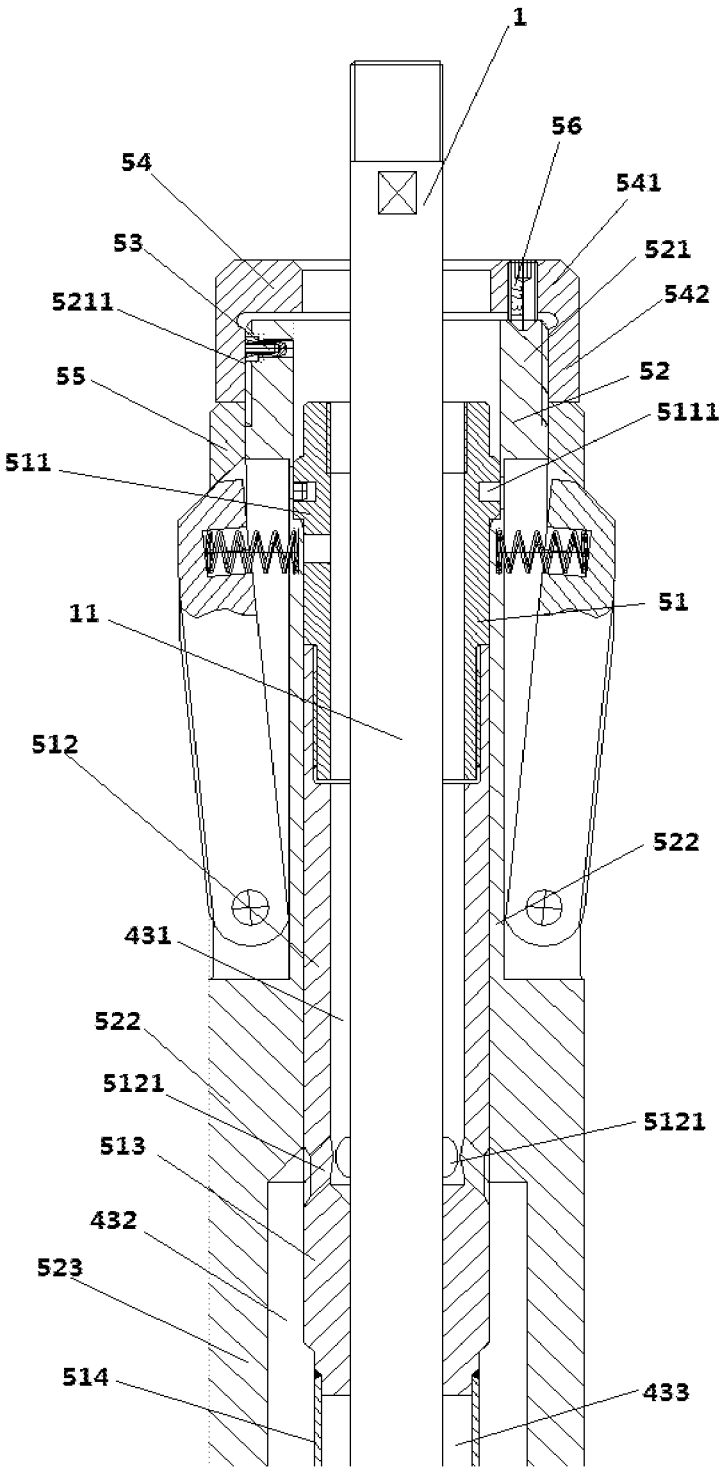
FIG. 3. An enlarged view of part A after the start shear pin is cut.

As shown in FIGS. 2 and 3, the fluid channel activation module comprises a lock body 52, a locking rod 51, and a start shear pin 53. Lock body 52 penetrates back and forth. The locking rod 51 and the lock body 52 are connected by the start shear pin 53. From back to front, the lock body 52 comprises the locking section 521, the sealing section A 522, and the fluid channel section 523. The outer wall of the locking section 521 has a start shear pin hole 5211, which is a through hole, and the length of starting shear pin 53 is longer than the depth of the start shear pin hole 5211. The locking rod 51 penetrates back and forth, and the locking rod 51 is in the lock body 52. The locking rod 51 comprises a connecting section 511, an outflow section A 512, a sealing section B 513, and an inflow section A 514 from back to front. The connecting section 511 is threadedly connected with the outflow section A 512, and the sealing section B 513 and the inflow section A 514 are welded. The outer wall of the connecting section 511 is provided with a start shear pin groove 5111, which is an annular groove. The start shear pin 53 is in the start shear pin hole 5211 and the start shear pin groove 5111. The inner diameter of the locking section 521 is greater than the inner diameter of the sealing section A 522. The outer wall of the connecting section 511 is provided with steps, whose outer diameter is greater than the inner diameter of the sealing section A 522. The outer diameter of the connecting section 511 in front of the step is equal to the inner diameter of the sealing section A 522. The starting shear pin groove 5111 is located on the outer wall of the step. The rear section 11 of the central rod is inside the locking rod 51. The inner diameter of the fluid channel section 523 is greater than the outer diameter of the locking rod 51. The inner diameter of the connecting section 511, the outflow section A 512, and the inflow section A 513 is greater than the outer diameter of the rear section 11 of the central rod. The sealing section B 513 is in a sealing fit with the rear section 11 of the central rod. There is a fluid channel A 431 between the rear section 11 of the central rod and the locking rod 51, and the fluid channel A 431 is behind the sealing section B 511. The back of the liquid channel A 431 is opened at the rear end of the locking rod 51. The side wall of the outflow section A 512 is provided with an outflow hole A 5121. The outflow hole A 5121 is behind the sealing section B 513. The outflow hole A 5121 is inclined forward from the inside to the outside. There are multiple outflow holes A 5121, and these holes A 5121 are evenly distributed along the circumference at the same axial position. The outflow holes A 5121 are connected to the fluid channel A 431. The sealing section A 522 and the sealing section B 513 are in a sealing fit. There is a fluid channel B 432 between the lock body 52 and the locking rod 51, which is in front of the sealing section A 522. The axial distance from the front end of the sealing section A 522 to the rear end of the lock body 52 is less than the axial distance from the front end of the sealing section B 513 to the rear end of the lock body 52. The start shear pin 53 passes through the start shear pin hole 5211 and is inserted into the start shear pin groove 5111. The axial distance from the outer wall opening of the outflow hole A 5121 to the rear end of the lock body 52 is less than the axial distance from the rear end of the fluid channel section 523 to the rear end of the lock body 52. A lock nut 54 and a sealing steel ring 55 are also comprised. The sealing steel ring 55 is connected to the lock body 52. The inner wall of the rear section of the sealing steel ring 55 is in contact with the outer wall of the lock body 52. The inner diameter of the rear section of the sealing steel ring 55 is shorter than the outer diameter of the lock body 52 in front of it. The inner diameter of the front section of the sealing steel ring 55 gradually increases from back to front, and the angle between the inner wall of the front section of the sealing steel ring 55 and the radial section are 45°. The lock nut 54 is behind the sealing steel ring 55, and the lock nut 54 compresses the sealing steel ring 55. The lock nut 54 penetrates back and forth, and the rear section 11 of the central rod passes through the inner cavity of the lock nut 54. The front end of the lock nut 54 is threadedly connected to the rear end of the lock body 52, and the start shear pin hole 5211 is opened at the rear thread of the lock body 52, and the radial distance from the inner wall of the lock nut 54 to the bottom of the start shear pin groove 5111 is not less than the length of the start shear pin 53. The lock nut 54 includes a fixing section 541 and a threaded section 542. The outer diameter of the connecting section 511 behind the step is shorter than the inner diameter of the fixing section 541, and smaller than the outer diameter of the step. The inner diameter of the threaded section 542 is equal to the outer diameter of the locking section 521. The lock nut 54 has a fixing hole A in the axial direction, which is a through hole. The lock body 52 has a fixing hole B on the rear face, which is a blind hole. The fixing hole A and the fixing hole B are matched. The fixing screw 56 is also included, and the length of the fixing screw 56 is greater than the depth of the fixing hole A. The fixing screw 56 is in the fixing hole A, and the front end of the fixing screw 56 passes the fixing hole A, and is inserted into the fixing hole B. After the fluid is supplied, the locking rod 51 moves forward, the start shear pin 53 is cut, the start shear pin head is in the start shear pin hole 5211, and the start shear pin tail 5111 is in the start shear pin groove. The start shear pin ends include a big end and a small end. The big end faces outwards, and the outer diameter of the big end is greater than the outer diameter of the small end. The start shear pin hole 5211 includes an outer section and an inner section, and the bore diameter of the outer section is not less than the outer diameter of the big end of the start shear pin, while the bore diameter of the inner section is not less than the outer diameter of the small end of the start shear pin. The bore diameter of the inner section is less than the outer diameter of the big end, and the depth of the outer section is not less than the length of the big end. The length sum of the small end and the start shear pin tail is greater than the depth of the inner section. Before the start shear pin 53 is cut, the outlet of the outflow hole A 5121 is at the sealing section A 522, and the front end of the fluid channel A 431 is sealed. After the start shear pin 53 is cut, the locking rod 51 moves forward, the outlet of the outflow hole A 5121 is in front of the sealing section A 522, and the fluid channel A 431 is connected to the fluid channel B 432 through the outflow hole A 5121.

Figure 4:
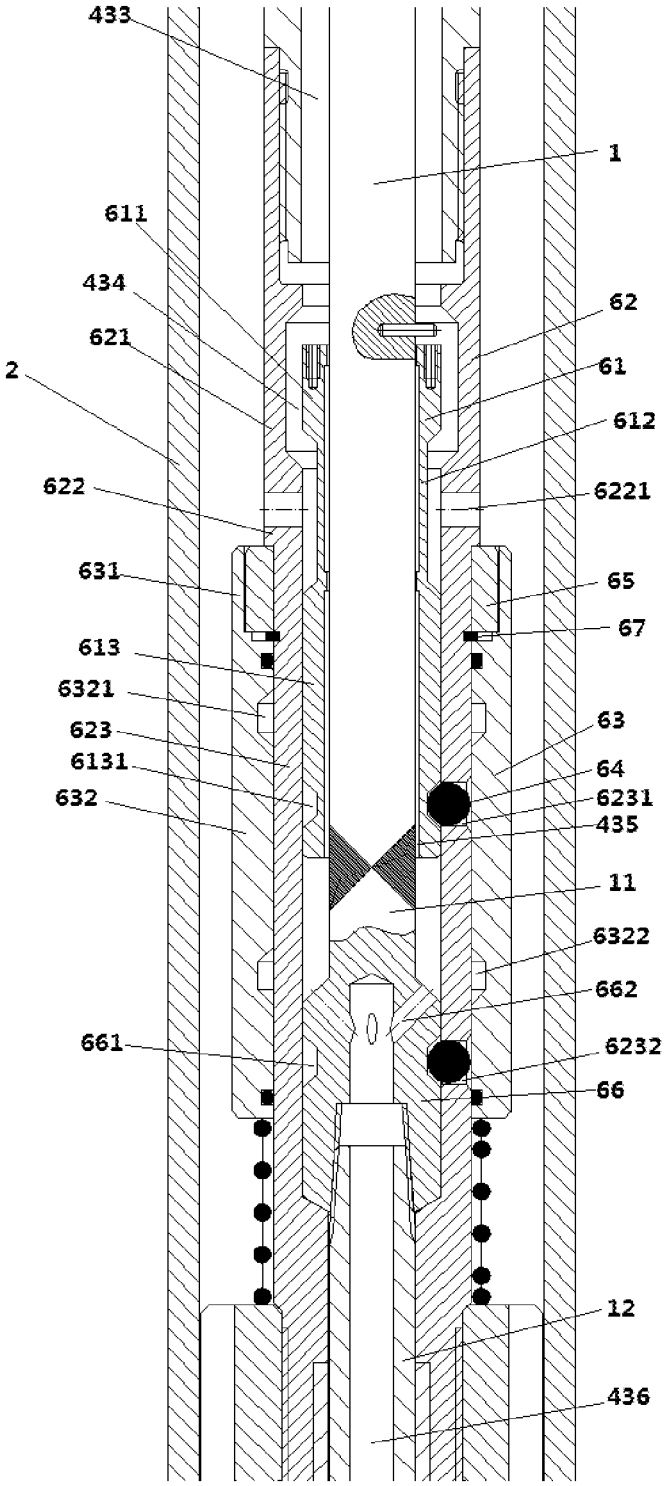
FIG. 4. An enlarged view of part C before stopping the drilling.
Figure 5:
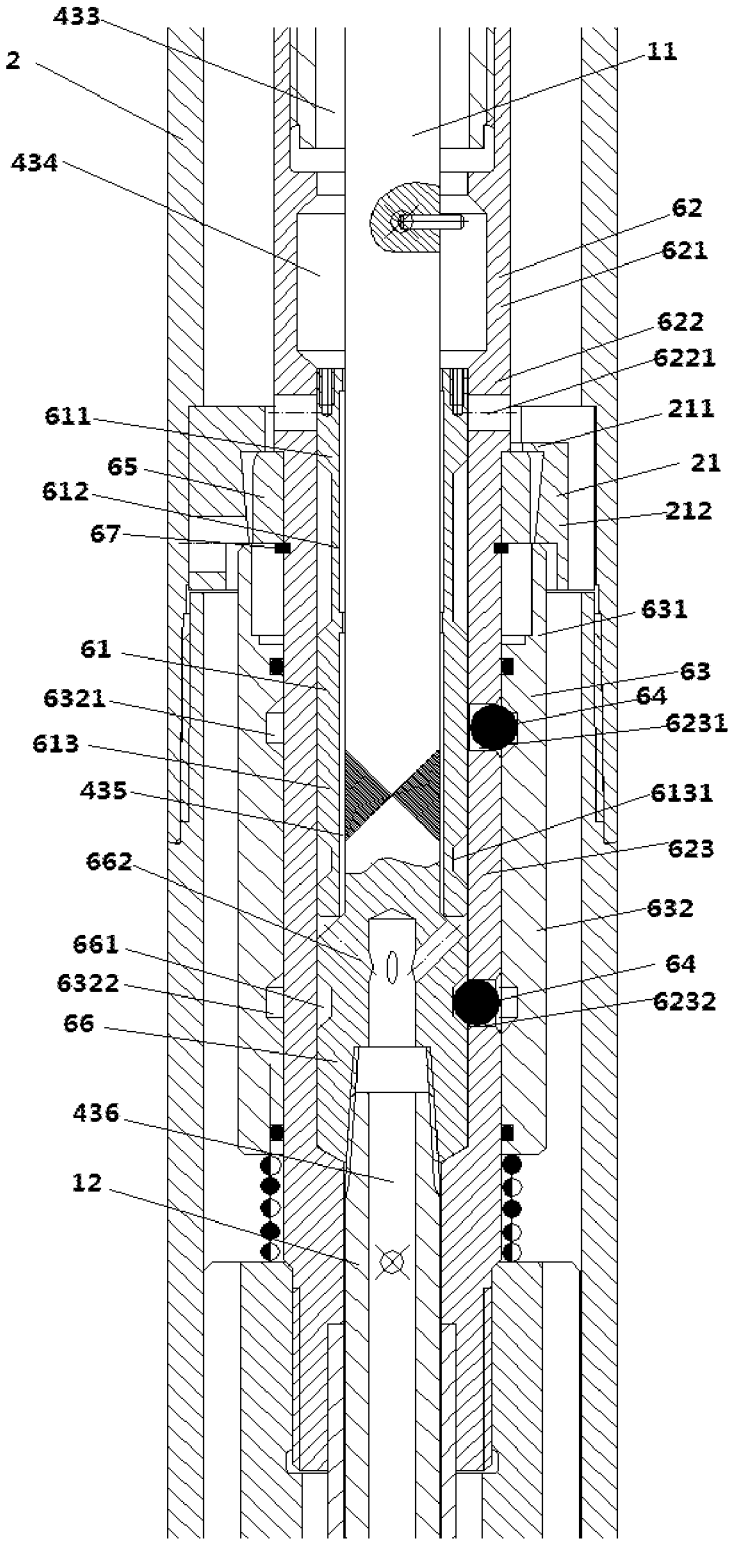
FIG. 5. An enlarged view of part C after stopping the drilling.

As shown in FIGS. 4 and 5, the flow diverging and blocking module comprises a valve housing 61, a lock housing 62, the locking sleeve 63, and the fixing ring 65. The central rod 1, the valve housing 61, the lock housing 62, the locking sleeve 63, the fixing ring 65, and the outer barrel 2 are coaxial. The rear section 11 of the central rod passes through the inner cavity of the valve housing 61, and the valve housing 61 is in the lock housing 62. The lock housing 62 passes through the inner cavity of the locking sleeve 63, and the valve housing 61 comprises a sealing section C 611, a diversion section 612 and a locking section A 613 from back to front. The outer wall of the locking section A 613 is provided with a locking groove A 613A 6131, which is an annular groove. The lock housing 62 includes an inflow section B 621, an outflow section B 622 and a locking section B 623 from back to front. The inner diameter of the inflow section B 621 is greater than the outer diameter of the sealing section C 611, while the outer diameter of the sealing section C 611 is greater than the outer diameter of the diversion section 612. The inner diameter of the outflow section B 622 is equal to the outer diameter of the sealing section C 611. There is a fluid channel D 434 between the central rod rear section 11 and the inflow section B 621, and there is a fluid channel E 435 between the outer wall of the central rod rear section 11 and the inner wall of the valve housing 61. The rear end of the fluid channel D 434 is connected to the fluid channel B 432, the fluid channel E 435 is connected to the fluid channel D 434, and the fluid channel E 435 is connected to the cooling fluid channel 42. The outflow section B 622 is provided with an outflow hole B 6221, and the outflow hole B 6221 is connected to the driving fluid channel 41. The width of the fluid channel E 435 is shorter than the width of the outflow hole B 6221, the width of the fluid channel E 435 is shorter than the width of the driving fluid channel 41. The locking section B 623 has a locking hole A 6231 and a locking hole B 6232. The locking hole B 6232 is in front of the locking hole A 6231. The outflow hole B 6221, the locking hole A 6231, and the locking hole B 6232 are all through holes with the same size. There is a locking ball 64 in both the locking hole A 6231 and the locking hole B 6232. The diameter of the locking ball 64 is greater than the depth of the locking hole A 6231. The locking sleeve 63 includes an impact section 631 and a locking section C632 from back to front. The inner wall of the locking section C632 has a locking groove B 6321 and a locking groove C 6322, and both grooves are annular and have the same size. The locking groove C 6322 is in front of the locking groove B 6321, and the distance between the locking groove B 6321 and the locking groove C 6322 is equal to the distance between the locking hole A 6231 and the locking hole B 6232. The distance from the bottom of the locking groove A 6131 to the inner wall of the locking section B 623 is less than the diameter of the locking ball 64, while the distance from the bottom of the locking groove A 6131 to the outer wall of the locking section B 623 is not less than the diameter of the locking ball 64. The distance from the bottom of the locking groove B 6321 and the locking groove C 6322 to the outer wall of the locking section B 623 is less than the diameter of the locking ball 64, while the distance from the bottom of the locking groove B 6321 and the locking groove C 6322 to the inner wall of the locking section B 623 is not less than the diameter of the locking ball 64. The fixing ring 65 is fixed on the outer wall of the locking section B 623, and the fixing ring 65 is behind the locking hole A 6231. The inner diameter of the impact section 631 is greater than the outer diameter of the fixing ring 65. The locking section C632 is in front of the fixing ring 65. The inner diameter of the outer barrel 2 is greater than the outer diameter of the lock housing 62 and the locking sleeve 63. A safety gear 21 is connected to the inner wall of the outer barrel 2, and the safety gear 21 includes a clamping part 211 and a pressing part 212 from back to front. The inner diameter of the front end of the pressing part 212 is shorter than the outer diameter of the impact section 631. The inner diameter of the pressing part 212 is not less than the outer diameter of the fixing ring 65. The inner diameter of the front end of the clamping part 211 is less than the outer diameter of the rear end of the fixing ring 65, and the front end of the central rod rear section 11 is connected to a limit end 66, which is in the locking section B 623 and in front of the locking section A 613. The outer wall of the limit end 66 is provided with a locking groove D 661, which is an annular groove. The locking groove D 661 is in front of the locking groove A 613A 6131. The gap between the outer wall of the limit end 66 and the inner wall of the lock housing 62 is less than the thickness of the front end of the locking section A 613, and the axial distance from the front end of the clamping part 211 to the front end of the pressing part 212 is equal to the axial distance from the hole center of the locking hole A 6231 to the center of the locking groove B 6321 before stopping the drilling. The distance from the rear end of the sealing section C 611 to the rear end of the outflow hole B 6221 before stop of the drilling is greater than the axial distance from the hole center of the locking hole A 6231 to the center of the locking groove A 613A 6131 after stop of the drilling. The axial distance from the hole center of the lock hole A 6231 to the center of the lock groove A 613A 6131 after stopping the drilling is greater than the distance from the front end of the sealing section C 611 to the front end of the outflow hole B 6221 before stopping the drilling. The lock housing 62 and the valve housing 61 are locked or unconstrained by the locking ball 64 in the locking hole A 6231, while the lock housing 62 and the locking sleeve 63 are locked or unconstrained by the locking ball 64 in the locking hole A 6231. The lock housing 62 and the central rod 1 are locked or released by the locking ball 64 in the locking hole B 6232. A snap ring 67 is also included. The outer diameter of the snap ring 67 is longer than the inner diameter of the fixing ring 65, and the inner diameter of the snap ring 67 is shorter than the inner diameter of the fixing ring 65. The snap ring 67 is inserted into the groove of the outer wall of the locking section B 623. The fixing ring 65 is snapped between the rear end of the snap ring 67 and the front end of the outflow section B 622. The front end of the locking section C632 is supported by a spring. Before stop of the drilling, the lock housing 62 is locked with the valve housing 61, the front end of the sealing section C 611 is at the inflow section B 621, and the fluid channel D 434 is connected to the outflow hole B 6221. The motor rotates, the outer barrel 2 has a built-in safety gear 21, and the outer barrel 2 moves forward to the limit position. The outer barrel 2 drives the safety gear 21 to hit the locking sleeve 63, so that the locking ball 64 in the locking hole A 6231 is moved outward, and the restriction on the valve housing 61 is released. The valve housing 61 moves forward, the sealing section C 611 and the outflow section B 621 are in a sealing fit, and the fluid channel D 434 is separated from the outflow hole B 6221. Thus, the driving fluid channel is closed, and the drilling is stopped. At this time, the locking groove D 661, the locking hole B 6232 and the locking groove C6321 are directly opposite. The locking ball 64 in the locking hole B 6232 moves outwards, and the constraint on the central rod 1 is released.

Figure 6:
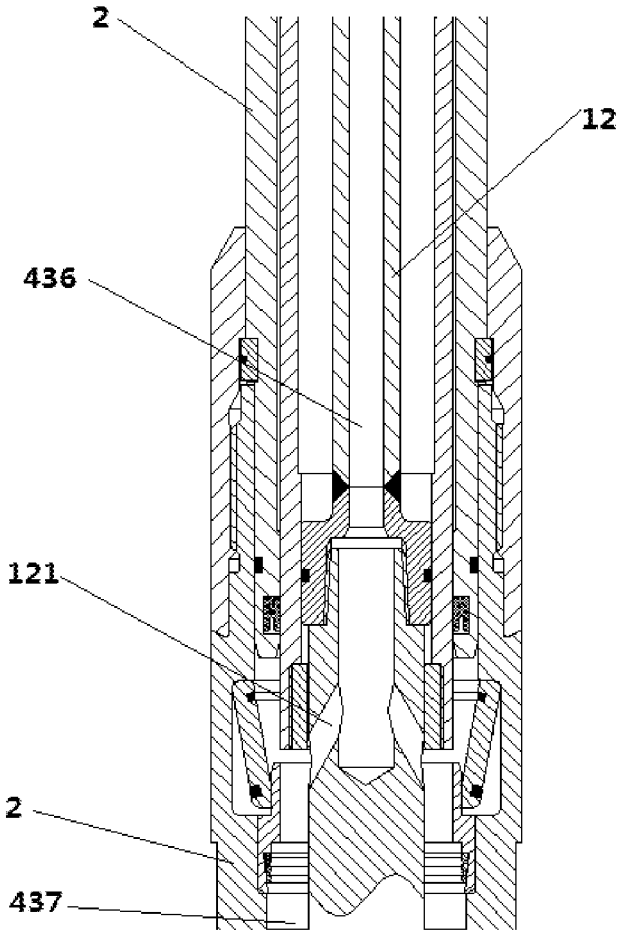
FIG. 6. An enlarged view of part D.
Figure 7:
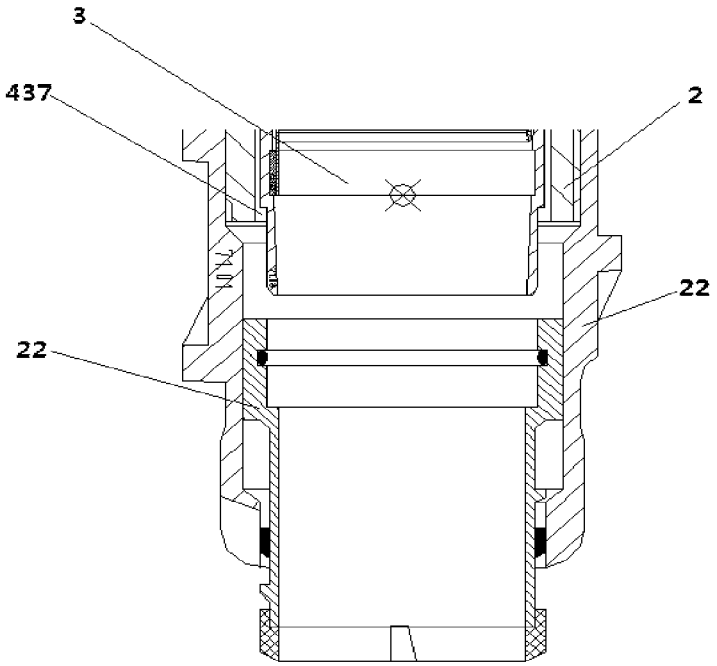
FIG. 7. An enlarged view of part E.
Figure 8:
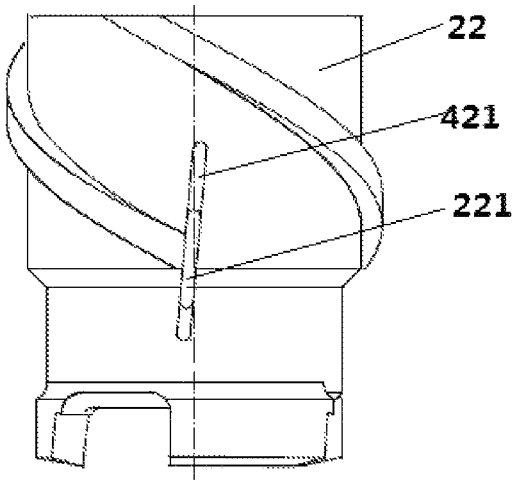
FIG. 8. Schematic diagram of the drill bit.

As shown in FIGS. 6 to 8, the front end of the limit end 66 is connected to the front section 12 of the central rod. There is a fluid channel F 436 in the axial direction inside the front section 12 of the central rod. The limit end 66 is provided with a cooling fluid inlet 662. The fluid channel E 435 is connected to the fluid channel F 436 through the cooling fluid inlet 662. The front end of the central rod front section 12 is sealed, which is connected to the integrity-preserving compartment 3. The central rod front section 12 and the integrity-preserving compartment 3 are both in the outer barrel 2, and the front side wall of the central rod front section 12 is provided with a cooling fluid outlet 121. There is a fluid channel G 437 in the interlayer between the integrity-preserving compartment 3 and the outer barrel 2. The fluid channel G 437 is connected to the fluid channel F 436 through the cooling fluid outlet 121. The cooling fluid channel 42 includes the fluid channel F 436, the fluid channel G 437, the cooling fluid inlet 662, and the cooling fluid outlet 121. The side wall of the drill bit 22 is provided with a front end opening 421 of the cooling fluid channel, and the blade 221 of the drill bit 22 passes through the front end opening 421, which is in communication with the fluid channel G 437.

Figure 9:
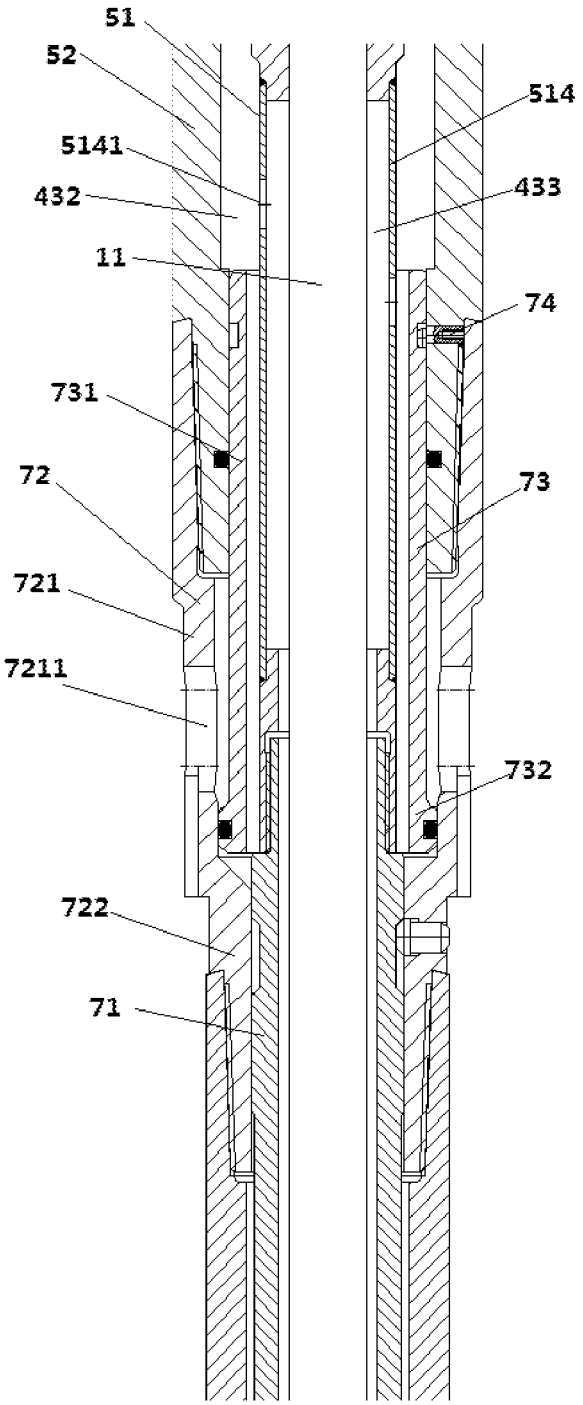
FIG. 9. An enlarged view of part B before stopping the drilling.
Figure 10:
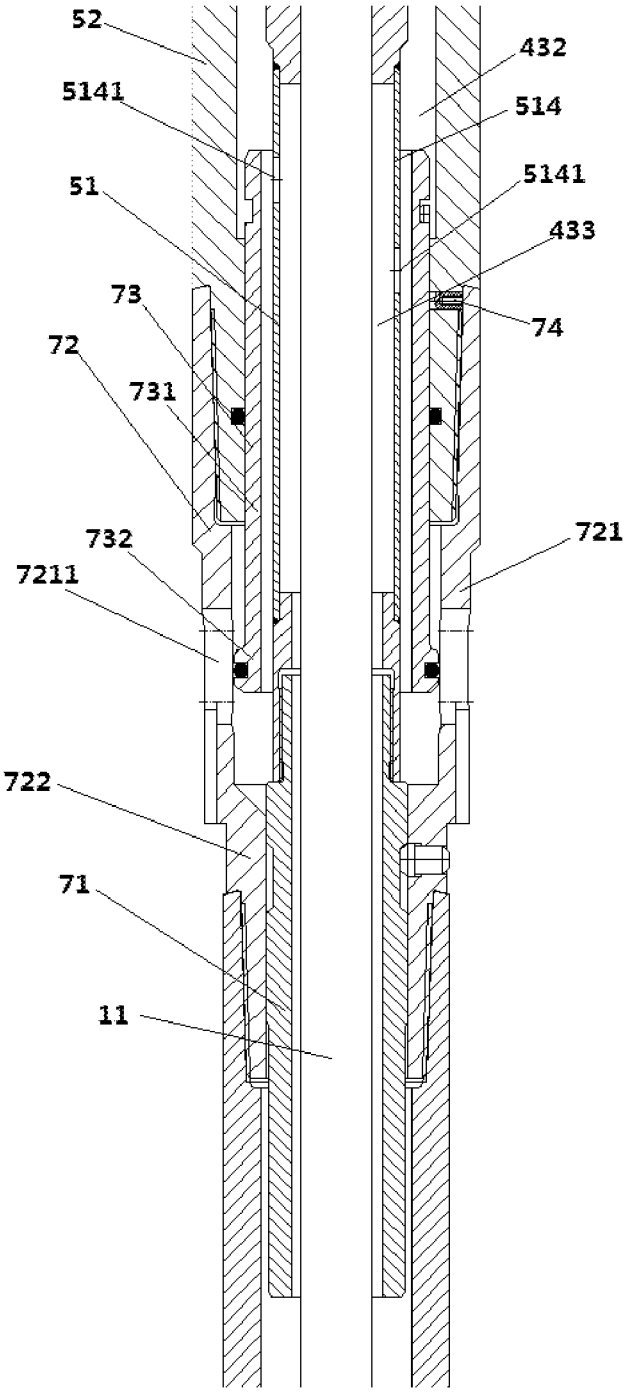
FIG. 10. An enlarged view of part B after stopping the drilling.

As shown in FIGS. 9 and 10, the pressure relief module comprises a connecting pipe 72 and a lock pin 71. The front end of the connecting pipe 72 is connected to the lock housing 62, while the rear end of the connecting pipe 72 is connected to the lock body 52. The rear end of the lock pin 71 is connected to the locking rod 51. The rear section 11 of the central rod penetrates the inner cavity of the lock pin 71, which is in the connecting pipe 72, and there is a fluid channel C 433 between the rear section 11 of the central rod and the lock pin 71 and the locking rod 51. The side wall of the locking rod 51 is provided with an inflow hole 5141, which is in the inflow section A 514. There are multiple inflow holes 5141, which are distributed back and forth on different sides. The fluid channel B 432 and the fluid channel C 433 are connected through the inflow hole 5141, and the fluid channel C 433 is connected to the fluid channel D 434. The connecting pipe 72 comprises a pressure relief section 721 and a flow blocking section 722 from back to front. The lock pin 51 is in a sealing fit with the blocking section 722, whose inner diameter is shorter than the inner diameter of the pressure relief section 721. There is a pressure relief hole 7211 at the pressure relief section 721, and the pressure relief hole 7211 is a through hole. There is a shearing plunger in the fluid channel B 432. The inner diameter of the shearing plunger 73 is longer than the outer diameter of the lock pin 71 and the locking rod 51, and the shearing plunger 73 is connected to the lock body 52 through the end shearing pin 74. The shearing plunger 73 includes a shearing section 731 and a recoil section 732 from back to front. The outer wall of the shearing section 731 and the inner wall of the lock body 52 are in a sealing fit. The outer diameter of the recoil section 732 is equal to the inner diameter of the front part of the pressure relief hole 7211 in the pressure relief section 721. Before stop of the drilling, the front end of the recoil section 732 is in front of the front end of the pressure relief hole 7211, and the recoil section 732 and the part of the pressure relief section 721 in front of the pressure relief hole 7211 are in a sealing fit. After stop of the drilling, the front fluid flows back and impacts the front end of the shearing plunger 73, and the shearing plunger 73 moves back. The front end of the recoil section 732 is behind the front end of the pressure relief hole 7211, and the fluid channel B 432 is connected to the pressure relief hole 7211, and the returning driving fluid is discharged from the pressure relief hole 7211.

Of course, there still may be many other examples of the present invention. Without departing from the spirit and the essence of the present invention, those skilled in the art can make various corresponding changes and deformations according to the invention, but these corresponding changes and deformations shall belong to the protection scope of the claims of the present invention.

The invention claimed is:

1. A drilling fluid channel structure of a core drilling rig, comprising a fluid channel activation module, a pressure relief module, a flow diverging and blocking module, a driving fluid channel, and a cooling fluid channel, wherein the fluid channel activation module, the pressure relief module, the flow diverging, and the blocking module are connected sequentially from a first end to a second end of the structure, the driving fluid channel and the cooling fluid channel are connected at a rear side thereof to the flow diverging and blocking module, wherein the driving fluid channel comprises a driving section and a driving fluid outlet, the driving section being disposed between a stator and a rotor of a driving motor, while the driving fluid outlet being disposed in front of the driving section, and the cooling fluid channel extends through a layer disposed between an integrity-preserving compartment and an outer barrel, and wherein a front end of the outer barrel is connected to a drill bit, and a front opening of the cooling fluid channel is located at the drill bit.

2. The drilling fluid channel structure of a core drilling rig according to claim 1, further comprising a rear section of the central rod, wherein the central rod extends through the fluid channel activation module, the pressure relief module, and the flow diverging and blocking module, wherein the fluid channel activation module comprises a lock body, a locking rod, and a start shear pin, the locking rod being disposed in the lock body, and the locking rod and the lock body being connected connected by the start shear pin, and wherein the rear section of the central rod is disposed in the locking rod, wherein the lock body comprises a sealing section A and the locking rod comprises a sealing section B, and the sealing section A and the sealing section B are in a sealing fit, wherein the sealing section B is in a sealing fit with the rear section of the central rod, wherein a fluid channel A is disposed between the rear section of the central rod and the locking rod, and a back opening of the fluid channel A is at a rear end of the locking rod, the locking rod is provided with an outflow hole A connected to the fluid channel A, the outflow hole A is disposed behind the sealing section B, wherein a fluid channel B is disposed between the lock body and the locking rod, and the fluid channel B is disposed in front of the sealing section A, wherein, before the start shear pin is cut, the outlet of the outflow hole A is at the seal section A and the front end of the fluid channel A is sealed, and the start shear pin is cut, the locking rod moves forward, and the outlet of the outflow hole A is disposed in front of the sealing section A so that the fluid channel A and the fluid channel B are connected through the outflow hole A.

3. The drilling fluid channel structure of a core drilling rig according to claim 2, wherein the flow diverging and blocking module comprises a valve housing, a lock housing, and a trigger mechanism, wherein the rear section of central rod extends through the inner cavity of the valve housing that is inside the lock housing, the valve housing comprises a sealing section C and a diversion section, the lock housing further comprises an inflow section B and an outflow section B, wherein a fluid channel D is disposed between the rear end of the central rod and the inflow section B and a fluid channel E is disposed between the outer wall of the rear section of the central rod and the inner wall of the valve housing, one end of the fluid channel D fluidly communicates with fluid channel B, and the fluid channel E fluidly communicates with the fluid channel D, and the fluid channel E fluidly communicates with the cooling fluid channel, wherein an inner diameter of the inflow section B is greater than an outer diameter of the sealing section C, and the outer diameter of the sealing section C is longer than the outer diameter of the diversion section, and an inner diameter of the outflow section B is equal to the outer diameter of the sealing section C, wherein the outflow section B is provided with an outflow hole B, which is connected to the driving fluid channel during operation, before drilling stops, the front end of sealing section C is in the inflow section B, and the fluid channel D and the outflow hole B are connected; after drilling stops, the sealing section C and the outflow section B are in a sealing fit, and the fluid channel D is separated from the outflow hole B.

4. The drilling fluid channel structure of a core drilling rig according to claim 3, wherein the valve housing further includes a locking section A connected to the front end of the diversion section, the lock housing further comprises a locking section B connected to the front end of the outflow section B, wherein the trigger mechanism comprises a locking sleeve, a fixing ring, and a safety gear, the locking sleeve being disposed is inside the outer barrel, wherein the lock housing passes through an inner cavity of the locking sleeve, and a safety gear is connected to an inner wall of the outer barrel, wherein the outer wall of the locking section A is provided with a locking groove A, wherein the locking section B has a locking hole A that is a through hole a locking ball is disposed in the locking hole A, wherein a diameter of the locking ball is greater than a depth of the locking hole A, the locking sleeve comprises an impact section and the locking section C, an inner wall of the locking section C has a locking groove B, and the fixing ring is affixed on the outer wall of the locking section B, wherein the fixing ring is disposed behind the locking hole A an inner diameter of the impact section is larger than an outer diameter of the fixing ring wherein the locking section C is disposed in front of the fixing ring, and the safety gear comprises a clamping part and a pressing part, and an inner diameter of the front end of the pressing part is smaller than an outer diameter of the impact section, and an inner diameter of the pressing part is not less than the outer diameter of the fixing ring, wherein an inner diameter of the front end of the clamping part is smaller than the outer diameter of the rear end of the fixing ring, and wherein a limit end is provided at the front end of the rear section of the central rod, and the limit end is disposed in the locking section B and in front of the locking section A.

5. The drilling fluid channel structure of a core drilling rig according to claim 4, wherein the front end of the limit end is connected to the front section of the central rod, a fluid channel F is disposed in the axial direction inside the front section of the central rod, and the limit end is provided with a cooling fluid inlet, the fluid channel E is connected to the fluid channel F through the cooling fluid inlet, wherein the front end of the central rod front section is sealed and is connected to the integrity-preserving compartment, the front section of the central rod and the integrity-preserving compartment are both disposed in the outer barrel, the front side wall of the front section of the central rod is provided with a cooling fluid outlet, and a fluid channel G in a layer disposed between an integrity-preserving compartment and an outer barrel, which is connected to the fluid channel F through the cooling fluid outlet, and, the cooling fluid channel comprises the fluid channel F, the fluid channel G, the cooling fluid inlet, and the cooling fluid outlet, and the front end of the fluid channel G is opened at the drill bit.

6. The drilling fluid channel structure of a core drilling rig according to claim 3, wherein the pressure relief module comprises a connecting pipe and a lock pin, a front end of the connecting pipe is connected to the lock housing, and a rear end of the connecting pipe is connected to the lock body, wherein a rear end of the lock pin is connected to the locking rod, the rear section of the central rod extends through the inner cavity of the lock pin disposed in the connecting pipe, wherein a fluid channel C is arranged between the rear section of the central rod, the lock pin, and the locking rod, a side wall of the locking rod is provided with an inflow hole, and the fluid channel B and the fluid channel C are communicated through the inflow hole, the fluid channel C fluidly communicates with the fluid channel D, wherein the connecting pipe comprises a pressure relief section and a flow blocking section, and the lock pin is in a sealing fit with the flow blocking section, wherein an inner diameter of the flow blocking section is smaller than that of the pressure relief section, the pressure relief section is provided with a pressure relief hole, which is a through hole, wherein a shearing plunger is disposed in the fluid channel B, and an inner diameter of the shearing plunger is larger than an outer diameter of the lock pin and the locking rod, wherein the shearing plunger is connected to the lock body through an end shear pin, the shearing plunger comprises a shearing section and a recoil section, an outer wall of the shearing section is in a sealing fit with the inner wall of the lock body, and the outer diameter of the recoil section is equal to the inner diameter for the front part of the pressure-relief hole in the pressure-relief section, during operation, before drilling stops, the front end of the recoil section is in front of the front end of the pressure-relief hole, and the recoil section is in a sealing fit with the front part of the pressure-relief hole in the pressure-relief section; and, after drilling stops, liquid backflow impacts the front end of the shearing plunger, and the shearing plunger moves backward, the front end of the recoil section is disposed behind the front end of the pressure-relief hole, and the fluid channel B communicates with the pressure-relief hole.

7. The drilling fluid channel structure of a core drilling rig according to claim 3, wherein a width of the fluid channel E is smaller than that of the outflow hole, and a width of the fluid channel E is smaller than that of the driving fluid channel.

8. The drilling fluid channel structure of a core drilling rig according to claim 2, wherein a plurality of outflow holes A are evenly distributed in a radial direction along a circumference of the structure.

9. The drilling fluid channel structure of a core drilling rig according to claim 1, wherein the driving fluid channel narrows at the driving fluid outlet, which is arranged in a radial direction and behind the integrity-preserving compartment.

* * * * *